US008967683B2

(12) United States Patent
Akizuki et al.

(10) Patent No.: US 8,967,683 B2
(45) Date of Patent: Mar. 3, 2015

(54) AUTOMOTIVE DOOR LATCH DEVICE

(75) Inventors: Ryujiro Akizuki, Novi, MI (US); Takashi Nishio, Kariya (JP); Nobuko Watanabe, Anjo (JP); Yasuhiko Sono, Hekinan (JP); Kazunori Kojima, Aichi-ken (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 160 days.

(21) Appl. No.: 13/579,181

(22) PCT Filed: Dec. 24, 2010

(86) PCT No.: PCT/JP2010/073332

§ 371 (c)(1),
(2), (4) Date: Aug. 29, 2012

(87) PCT Pub. No.: WO2011/102057

PCT Pub. Date: Aug. 25, 2011

(65) Prior Publication Data

US 2012/0313385 A1 Dec. 13, 2012

(30) Foreign Application Priority Data

Feb. 19, 2010 (JP) ..... 2010-034847

(51) Int. Cl.
*E05C 3/06* (2006.01)
*E05B 85/26* (2014.01)
(Continued)

(52) U.S. Cl.
CPC ..... *E05B 85/26* (2013.01); *E05B 77/34* (2013.01); *E05B 85/02* (2013.01); *E05B 2015/041* (2013.01); *Y10S 292/23* (2013.01)
USPC ..... 292/216; 292/DIG. 23; 292/201

(58) Field of Classification Search
USPC ..... 292/216
See application file for complete search history.

(56) References Cited

U.S. PATENT DOCUMENTS 5,758,912 A 6/1998 Hamada
6,471,260 B1 * 10/2002 Weinerman et al. ..... 292/216
(Continued)

FOREIGN PATENT DOCUMENTS

GB 2325271 A 11/1998
JP 59-118968 A 7/1984
(Continued)

OTHER PUBLICATIONS

International Search Report (PCT/ISA/210) issued on Apr. 5, 2011, by the Japanese Patent Office as the International Searching Authority for International Application No. PCT/JP2010/073332.
(Continued)

*Primary Examiner* — Mark Williams
(74) *Attorney, Agent, or Firm* — Buchanan Ingersoll & Rooney PC

(57) ABSTRACT

Provided is an automotive door latch device, including: a latch pushed to rotate by a striker; a latch return spring for biasing the latch toward a return position thereof; a pawl engageable with the latch to inhibit the latch to pivot in a door opening direction (return position); and a pawl return spring for biasing the pawl toward a return position thereof. A housing part of a body, which houses the latch and the pawl, is opened downward at a position below the pawl on one side of the body. The pawl return spring is assembled to a spring mounting part formed on another side of the body at a position spaced downward from a rotational support part of the pawl, and includes a pawl-side end part that engages with the pawl through a through hole provided in the body. Thus, dust or the like entering the housing part of the body, which houses the latch and the pawl, can be discharged out of the body with higher efficiency.

18 Claims, 10 Drawing Sheets

(51) Int. Cl.

| | |
|---|---|
| *E05B 77/34* | (2014.01) |
| *E05B 85/02* | (2014.01) |
| *E05B 15/04* | (2006.01) |

(56) References Cited

U.S. PATENT DOCUMENTS

| | | | | |
|---|---|---|---|---|
| 7,152,890 | B2 * | 12/2006 | Torkowski et al. | 292/216 |
| 7,467,815 | B2 * | 12/2008 | Larsen et al. | 292/201 |
| 7,789,440 | B2 * | 9/2010 | Graute et al. | 292/216 |
| 8,235,428 | B2 * | 8/2012 | Hunt et al. | 292/216 |
| 2004/0145191 | A1 | 7/2004 | Watanabe | |
| 2008/0060397 | A1 | 3/2008 | Sato | |

FOREIGN PATENT DOCUMENTS

| | | | |
|---|---|---|---|
| JP | 2-96077 | A | 4/1990 |
| JP | 2006-37655 | A | 2/2006 |
| JP | 2007326462 | A | 12/2007 |
| JP | 2008-63908 | A | 3/2008 |

OTHER PUBLICATIONS

Written Opinion (PCT/ISA/237) issued on "Date WO issued", by the Japanese Patent Office as the International Searching Authority for International Application No. PCT/JP2010/073332.

Office Action (Notification) issued on Feb. 28, 2014, by the Chinese Patent Office in corresponding Chinese Patent Application No.: 201080064052.5, and an English translation of the Office Action. (12 pages).

* cited by examiner

AUTOMOTIVE DOOR LATCH DEVICE

TECHNICAL FIELD

The present invention relates to an automotive door latch device.

BACKGROUND ART

As one of the automotive door latch devices, there is an automotive door latch device described in, for example, Patent Document 1 below. In the automotive door latch device, a latch adapted to be pushed to rotate by a striker on a vehicle body side is housed in a housing part formed on one side of a body, and is rotatably supported via a first support shaft on a base plate adapted to be arranged so as to cover the housing part of the body on one side thereof and assembled to a door. Further, the latch is biased toward its return position by a latch return spring. A pawl engageable with the latch to inhibit the latch to pivot in a door opening direction is housed in the housing part of the body at a position below the latch, and is rotatably supported on the base plate via a second support shaft. Further, the pawl is biased toward its return position by a pawl return spring.

PRIOR ART DOCUMENT

Patent Document

Patent Document 1: Japanese Patent Application Laid-Open (kokai) No. 2006-37655

In the automotive door latch device described in the above-mentioned Patent Document 1, the pawl return spring is not arranged on an axial extension line of the pawl, but is arranged below the latch and the pawl in the housing part (space) of the body that houses the latch and the pawl. Therefore, the pawl return spring can be arranged with an ensured degree of freedom, which is suitable for a case where a mounting space for the pawl return spring is hard to be ensured on the axial extension line of the pawl.

SUMMARY OF THE INVENTION

Technical Problem

In the automotive door latch device described in the above-mentioned Patent Document 1, however, the pawl return spring is arranged below the pawl in its vicinity in the housing part (space) of the body that houses the latch and the pawl. Therefore, dust or the like entering the housing part (space) of the body that houses the latch and the pawl is hindered by the pawl return spring from being discharged out of the body, and may consequently be deposited in the housing part (space) described above.

Solution to Problem

The present invention has been made to solve the above-mentioned problem, and therefore provides an automotive door latch device, including: a base plate adapted to be assembled to a door; a body including a housing part formed on one side thereof, the housing part being covered with the base plate on one side thereof; a latch housed in the housing part of the body and rotatably supported on the base plate via a first support shaft, the latch being adapted to be pushed to rotate by a striker on a vehicle body side; a latch return spring housed in the housing part of the body, for biasing the latch toward a return position thereof; a pawl housed in the housing part of the body at a position below the latch and rotatably supported on the base plate via a second support shaft, the pawl being engageable with the latch to inhibit the latch to pivot in a door opening direction; and a pawl return spring for biasing the pawl toward a return position thereof, in which the housing part of the body is opened downward at a position below the pawl, and in which the pawl return spring is assembled to a spring mounting part formed on another side of the body at a position spaced downward from a rotational support part of the pawl, the pawl return spring includes a pawl-side end part that enters the housing part of the body through a through hole provided in the body, and engages with the pawl.

In this case, the pawl return spring includes: a coil part provided at a middle portion thereof; the pawl-side end part provided at one end portion thereof; and a body-side end part provided at another end portion thereof. Further, the spring mounting part formed on the body includes: a retaining part for retaining the coil part; and a lock part engaging with the body-side end part. Further, the through hole may have a long hole shape elongated so as to allow movement of the pawl-side end part of the pawl return spring in a movement direction, in which the pawl-side end part moves when the pawl pivots to allow the pivot of the latch, beyond a range in which the pawl-side end part moves when the pawl pivots.

When carrying out the present invention described above, the second support shaft that rotatably supports the pawl may be made of a metal. Further, the automotive door latch device may further include a lift lever made of a metal, the lift lever including an insertion hole, through which the second support shaft is insertable, the lift lever being assembled to the second support shaft so as to be rotatable integrally with the pawl. Further, the body may be made of a resin, and further include an extending part, which extends along the second support shaft and is inserted through the insertion hole of the lift lever so that the extending part is interposed between the lift lever and the second support shaft and rotatably supports the lift lever. In this case, the extending part may be formed into a cylindrical shape, and surround an entire circumference of the second support shaft.

In those cases, the base plate may non-rotatably support the second support shaft on one end side thereof. Further, the automotive door latch device may further include a sub-base plate, which is assembled on the another side of the body and is positioned by the extending part, the sub-base plate non-rotatably supporting the second support shaft at another end portion thereof. Further, the pawl and the lift lever may be rotatably supported on the second support shaft. Further, the body may further include a support part extending in a circumferential direction from the extending part on the base plate side thereof. Further, the lift lever may be disposed between the support part of the body and the sub-base plate.

Further, in those cases, the lift lever may further include a projecting part bent toward the pawl to pass through the body. Further, the pawl may include a depressed part fittable to the projecting part. Further, the body may further include an opening part that allows passage and rotation of the projecting part. Further, the projecting part may pass through the opening part and be fitted to the depressed part so that the lift lever and the pawl are rotatable integrally with each other.

When carrying out the present invention described above, the pawl may further include an engagement projecting part. Further, the automotive door latch device may further include a stopper mounted to the body so as to be arranged above the engagement projecting part, the stopper abutting against the engagement projecting part to define the return position of the pawl.

Advantageous Effects of Invention

In the automotive door latch device according to the present invention, the housing part of the body is opened downward at the position below the pawl. Further, the pawl return spring is assembled to the spring mounting part formed on another side of the body at the position spaced downward from the rotational support part of the pawl. The pawl-side end part of the pawl return spring enters the housing part of the body through the through hole provided in the body, and engages with the pawl. Therefore, the size of the opening formed below the housing part of the body is not reduced due to the pawl return spring and the spring mounting part of the body. Accordingly, an opening having a necessary and sufficient size can be formed in the body. Thus, dust or the like entering the housing part of the body can be discharged out of the body with higher efficiency, and thus troubles that may occur along with deposition of the dust or the like can be suppressed effectively.

Further, the pawl return spring is assembled to the spring mounting part formed on another side of the body at the position spaced downward from the rotational support part of the pawl. Accordingly, the pawl return spring can be arranged with a higher degree of freedom than in the case where the pawl return spring is coaxially assembled to the rotational support part (shaft part) of the pawl.

When carrying out the present invention described above, in the cases where the pawl return spring includes the coil part provided at the middle portion thereof, the body-side end part provided at one end portion thereof, and the pawl-side end part provided at another end portion thereof, and where the spring mounting part formed on the body includes the retaining part for retaining the coil part, and the lock part engaging with the body-side end part, under a sub-assembly state obtained by combining the components other than the pawl return spring (body, base plate, latch, pawl, support shaft of the latch, support shaft of the pawl, latch return spring, and the like), the pawl-side end part of the pawl return spring is passed through and inserted into the through hole of the body so that the pawl-side end part is engaged with the lock part of the pawl. Subsequently, the coil part of the pawl return spring is assembled to the retaining part of the spring mounting part formed on the body, and finally, the body-side end part of the pawl return spring is assembled to the lock part provided in the spring mounting part. Consequently, the pawl return spring can be assembled. Therefore, the biasing force of the pawl return spring does not hinder the assembly of the components when the sub-assembly is obtained by combining the components other than the pawl return spring, and thus the components can be assembled with satisfactory efficiency when the sub-assembly is obtained.

Further, when carrying out the present invention described above, in the case where the through hole provided in the body has the long hole shape as described above, the pawl-side end part of the pawl return spring is easily assembled to the body, and thus the pawl return spring can be assembled with enhanced efficiency.

Further, when carrying out the present invention described above, in the cases where the second support shaft is made of a metal, where the lift lever assembled so as to be rotatable integrally with the pawl is made of a metal, and where the body is made of a resin and includes the above-mentioned extending part, a bush (resin bearing) function can be imparted to the extending part of the body that is made of a resin, and thus metallic contact between the lift lever and the second support shaft can be eliminated without adding components. Therefore, noise due to the metallic contact occurring when the lift lever is actuated can be prevented. In that case, when the extending part is formed into a cylindrical shape and surrounds the entire circumference of the second support shaft, the above-mentioned noise due to the metallic contact can be prevented more suitably.

Further, when carrying out the present invention described above, in the cases where the base plate non-rotatably supports the second support shaft on one end side thereof, where the sub-base plate, which is assembled on the another side of the body and is positioned by the extending part, non-rotatably supports the second support shaft at another end portion thereof, where the pawl and the lift lever are rotatably supported on the second support shaft, where the body includes the support part extending in the circumferential direction from the extending part on the base plate side thereof, and where the lift lever is disposed between the support part of the body and the sub-base plate, the lift lever can be prevented from being sandwiched between the support part of the body and the sub-base plate, and thus smooth rotation of the lift lever can be guaranteed. Further, in that case, a part of the pawl and a part of the lift lever are fitted to each other in the axial direction. Accordingly, the pawl and the lift lever can be coupled to each other so as to be rotatable integrally with each other. Therefore, manufacturability can be enhanced as compared to a case where, for example, the pawl and the second support shaft are integrated, the lift lever is fixed to the second support shaft by caulking or the like, and the second support shaft is rotatably coupled to the base plate and the sub-base plate.

Further, when carrying out the present invention described above, in the cases where the lift lever includes the projecting part bent toward the pawl to pass through the body, where the pawl includes the depressed part fittable to the projecting part, where the body includes the opening part that allows the passage and rotation of the projecting part, and where the projecting part passes through the opening part and is fitted to the depressed part so that the lift lever and the pawl are rotatable integrally with each other, the pawl and the lift lever can be coupled to each other so as to be rotatable integrally with each other without providing a separate component, such as a coupling pin, to the lift lever, and thus the pawl and the lift lever can be formed simply at low cost.

Further, when carrying out the present invention described above, in the cases where the pawl includes the engagement projecting part, and where the stopper is mounted to the body so as to be arranged above the engagement projecting part, the engagement projecting part of the pawl abuts against the lower surface of the stopper to define the return position of the pawl. Therefore, dust or the like is not easily deposited between the engagement projecting part of the pawl and the stopper, and accordingly shift of the return position of the pawl due to the dust or the like can be suppressed. Thus, the function of the pawl (function of inhibiting the rotation of the latch in the door opening direction at a predetermined position) can be obtained stably for a long period of time.

MODE FOR CARRYING OUT THE INVENTION

Figure 1:
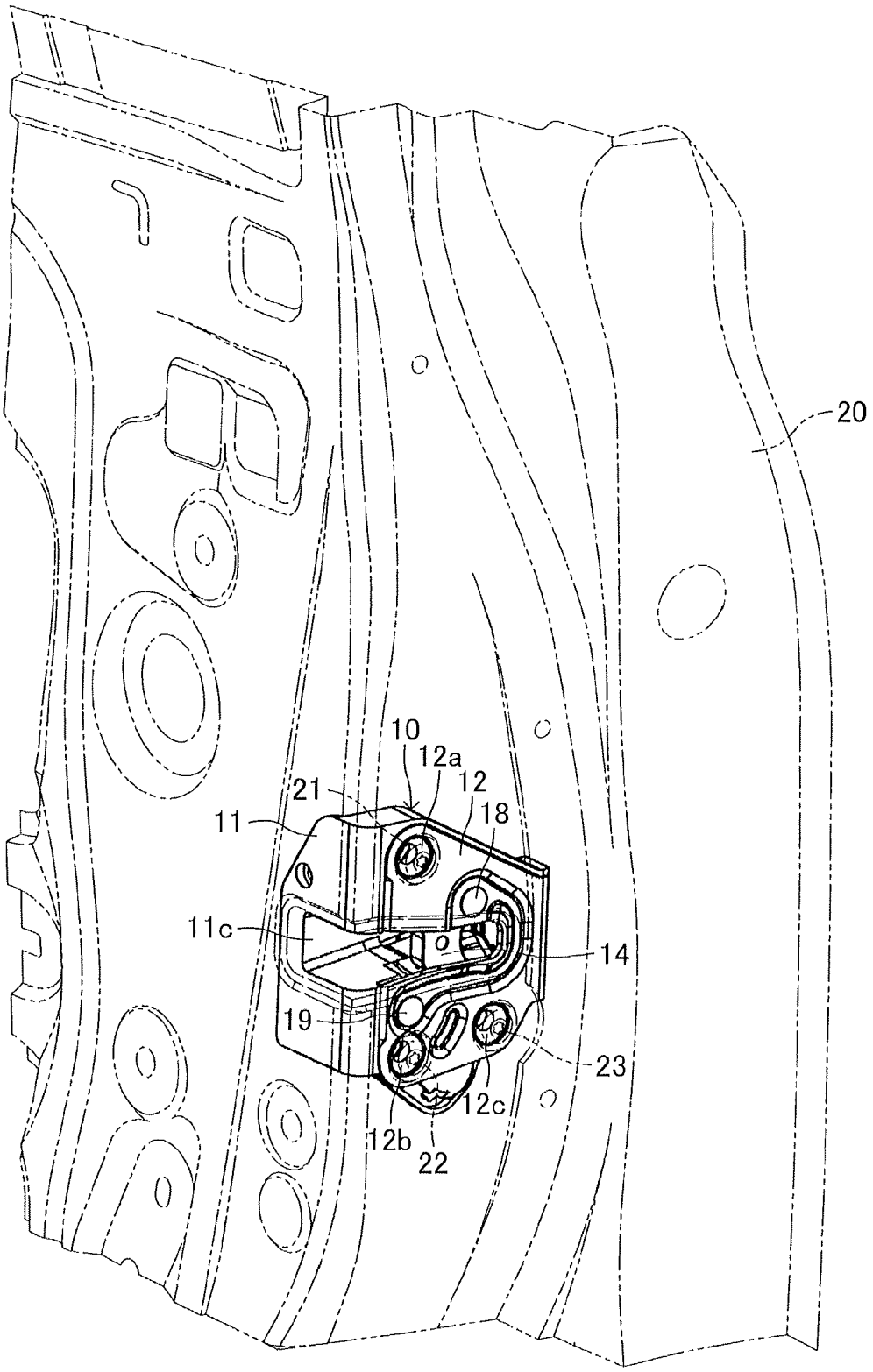
FIG. 1 is a perspective view for illustrating an automotive door latch device together with a door according to an embodiment (first embodiment) of the present invention.

Hereinafter, embodiments of the present invention are described with reference to the drawings. FIGS. 1 to 5 illustrate an automotive door latch device according to an embodiment (first embodiment) of the present invention. An automotive door latch device 10 of this embodiment is mounted together with a door lock device (not shown) to a door 20 (see the imaginary lines of FIG. 1) equipped on a front right side of an automobile. The automotive door latch device 10 includes a body 11 made of a resin, a base plate 12 made of a steel plate, and a sub-base plate 13 made of a steel plate, and further includes a latch 14 made of a metal, a latch return spring S1 made of spring steel, a pawl 15 made of a metal, a pawl return spring S2 made of spring steel, a stopper 16 made of rubber, and a lift lever 17 made of a steel plate (metal).

As illustrated in FIGS. 5 to 10, the body 11 includes housing parts 11*a*1 and 11*a*2 for housing the latch 14 and the pawl 15, respectively, and the housing parts 11*a*1 and 11*a*2 are formed on one side of a longitudinal wall W (side on which the base plate 12 is assembled) interposed between the base plate 12 and the sub-base plate 13. The body 11 further includes a spring mounting part 11*b* for assembling the pawl return spring S2, and the spring mounting part 11*b* is formed on another side of the longitudinal wall W (side on which the sub-base plate 13 is assembled). Further, the body 11 includes a striker insertion groove 11*c*, two support shaft insertion holes 11*d* and 11*e*, three bolt insertion holes 11*f*, 11*g*, and 11*h*, and a stopper mounting part 11*i*, and further includes a cutout 11*j*, a through hole 11*k*, and a projection 11*m*.

Figure 5:
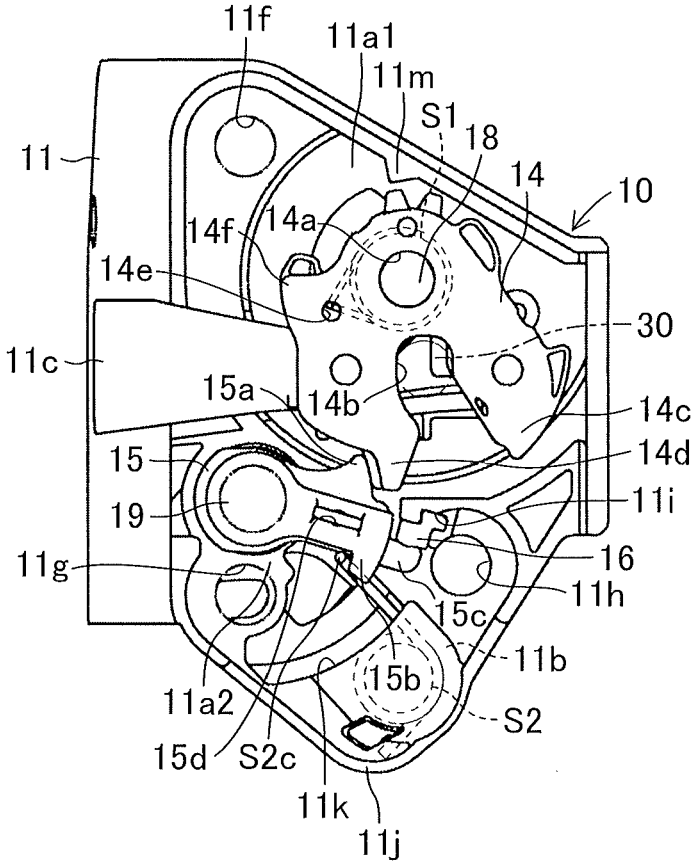
FIG. 5 is a front view of the automotive door latch device illustrated in FIG. 2 in a state in which a base plate is removed therefrom.
Figure 14:
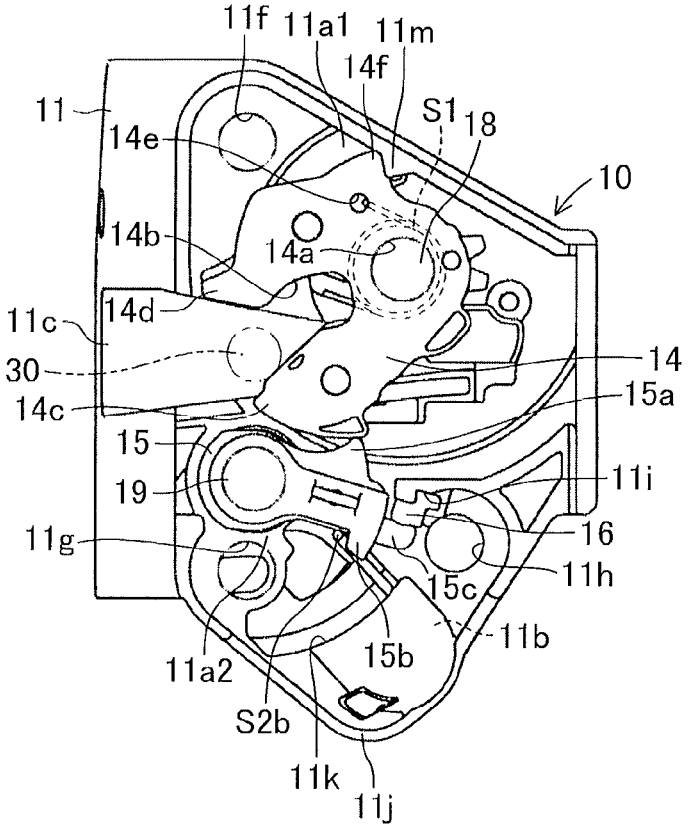
FIG. 14 is a front view of the automotive door latch device illustrated in FIG. 13 in a state in which the base plate is removed therefrom.

As illustrated in FIG. 5, the upper housing part 11*a*1 houses the latch 14 so that the latch 14 is pivotable by a predetermined amount, and the projection 11*m* projects inward to define a return position of the latch 14 (see FIG. 14). As illustrated in FIG. 5, the lower housing part 11*a*2 houses the pawl 15 so that the pawl 15 is rotatable by a predetermined amount, and communicates to the upper housing part 11*a*1 at a portion at which the pawl 15 engages with the latch 14. Note that, the housing parts 11*a*1 and 11*a*2 are partially covered with the base plate 12 on one side thereof.

Figure 3:
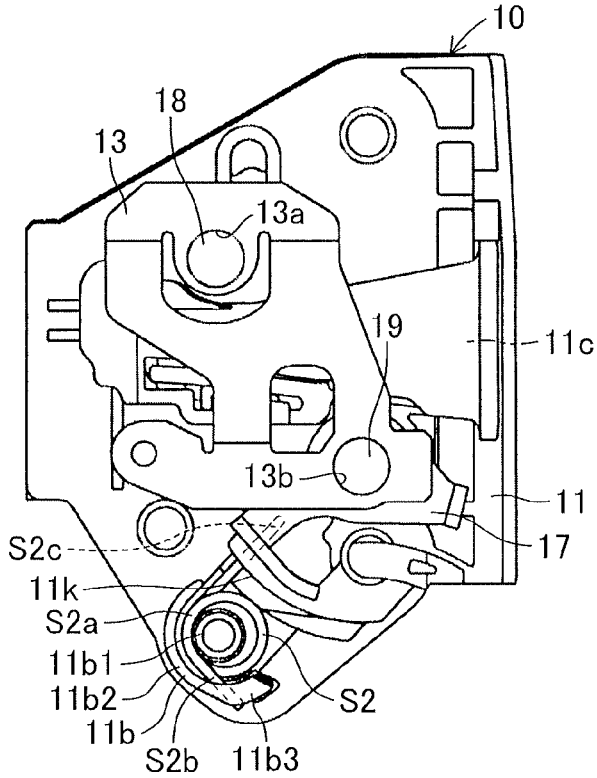
FIG. 3 is a rear view of the automotive door latch device illustrated in FIG. 2.
Figure 6:
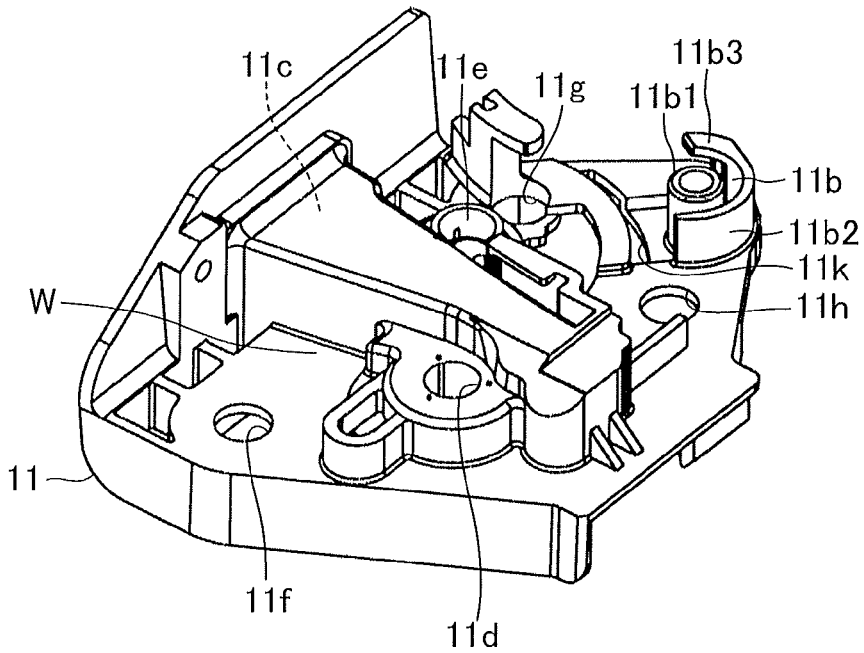
FIG. 6 is a perspective view of a body of the automotive door latch device illustrated in FIGS. 1 to 5 as seen from an upper side of a rear surface thereof.
Figure 7:
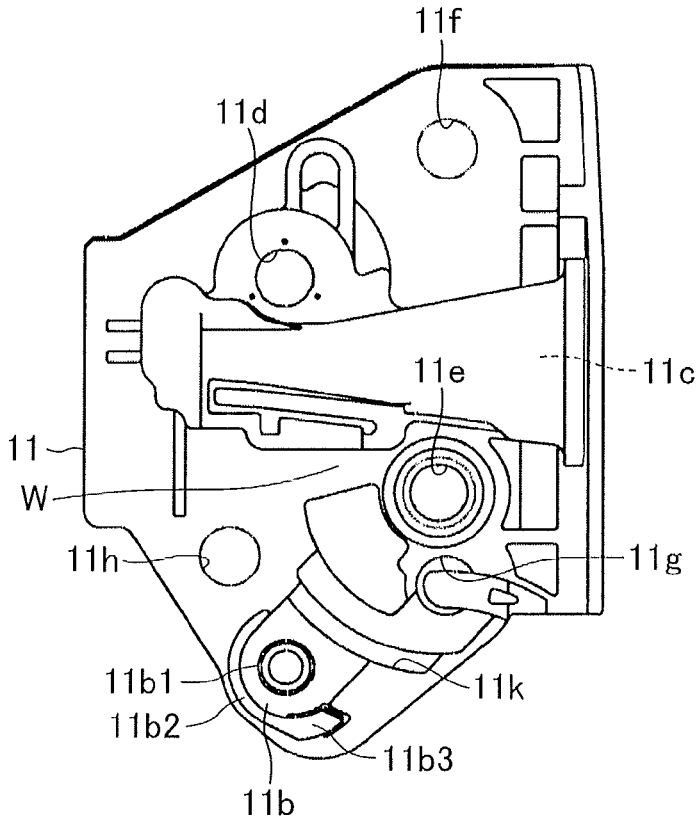
FIG. 7 is a rear view of the body illustrated in FIG. 6.
Figure 8:
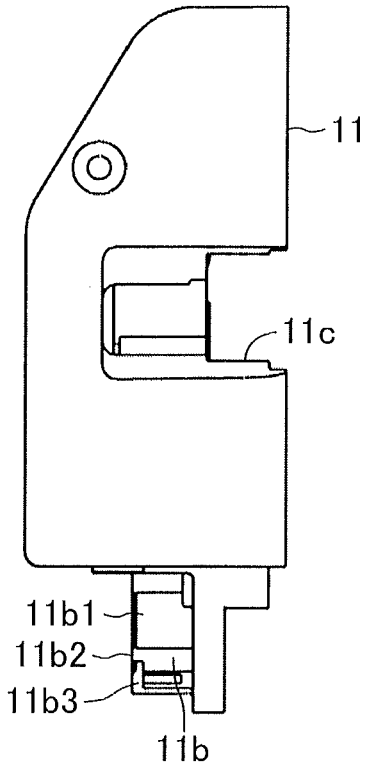
FIG. 8 is a side view of the body illustrated in FIG. 7 as seen from a right side thereof.
Figure 9:
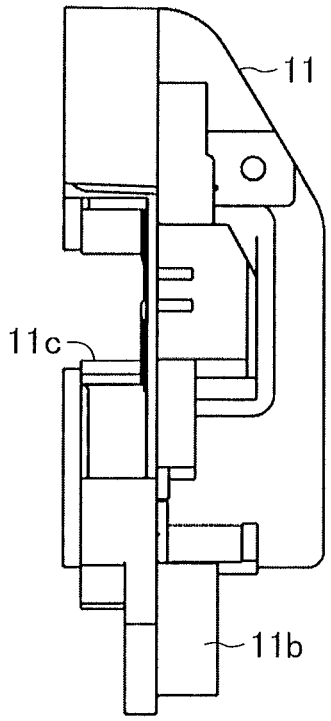
FIG. 9 is a side view of the body illustrated in FIG. 7 as seen from a left side thereof.
Figure 10:
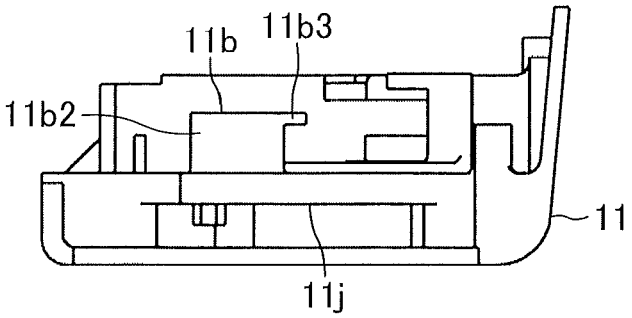
FIG. 10 is a bottom view of the body illustrated in FIG. 7 as seen from a lower side thereof.

The spring mounting part 11*b* is formed on another side of the body 11 at a position spaced obliquely downward from a rotational support part (support shaft 19) of the pawl 15, and as illustrated in FIGS. 3, 6, and 7, the spring mounting part 11*b* includes a shaft part 11*b*1 and an arc-like wall part 11*b*2 (retaining part) for retaining a coil part S2*a* of the pawl return spring S2, and a lock part 11*b*3 engaging with a body-side end part S2*b* of the pawl return spring S2. Note that, the lock part 11*b*3 is formed so as to project from an end portion of the arc-like wall part 11*b*2.

The striker insertion groove 11*c* is a groove where a known striker 30 (see the imaginary lines of FIGS. 5, 12, and 14) assembled on a vehicle body side relatively enters and exits when the door 20 is opened and closed, and is formed horizontally at a center of the body 11. The upper support shaft insertion hole 11*d* is a through hole, through which a support shaft 18 (first support shaft) for rotatably supporting the latch 14 is inserted. On the other hand, the lower support shaft insertion hole 11*e* is a through hole, through which the support shaft 19 (second support shaft) rotatable integrally with the pawl 15 is inserted.

The three bolt insertion holes 11*f*, 11*g*, and 11*h* are insertion holes, through which, when the door latch device 10 is assembled to the door 20 with three bolts 21, 22, and 23 (see FIG. 1), tip end portions of the bolts 21, 22, and 23 are inserted while being screwed into bolt fixing hole parts (internal thread parts) 12*a*, 12*b*, and 12*c* provided in the base plate 12. As illustrated in FIG. 5, the stopper mounting part 11*i* is provided at a portion projecting in a canopy shape between the housing parts 11*a*1 and 11*a*2 described above, and the stopper 16 is fitted and fixed to the stopper mounting part 11*i*.

Figure 4:
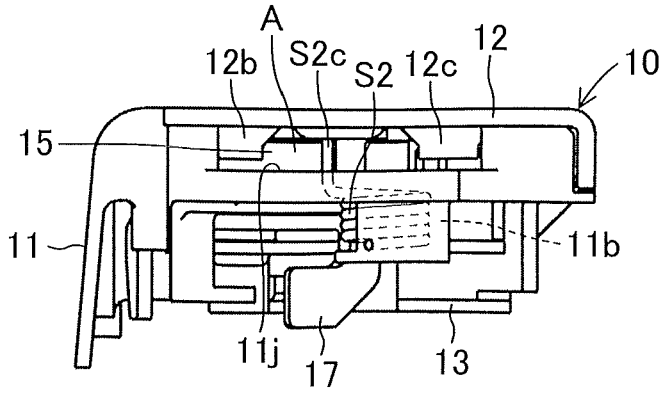
FIG. 4 is a bottom view of the automotive door latch device illustrated in FIG. 2.

As illustrated in FIG. 5, the cutout 11*j* is provided at one lower side portion of the body 11, and as illustrated in FIG. 4, forms an opening part A together with the base plate 12. The opening part A opens the housing parts 11*a*1 and 11*a*2 downward at a position below the pawl 15, and as illustrated in FIG. 4, the opening part A is formed into a rectangular shape as seen from the lower side. The through hole 11*k* is formed into an arc shape in the longitudinal wall W at a position between the housing part 11*a*2 and the spring mounting part 11*b* described above, and a pawl-side end part S2*c* of the pawl return spring S2 is insertable into the through hole 11*k*.

Figure 2:
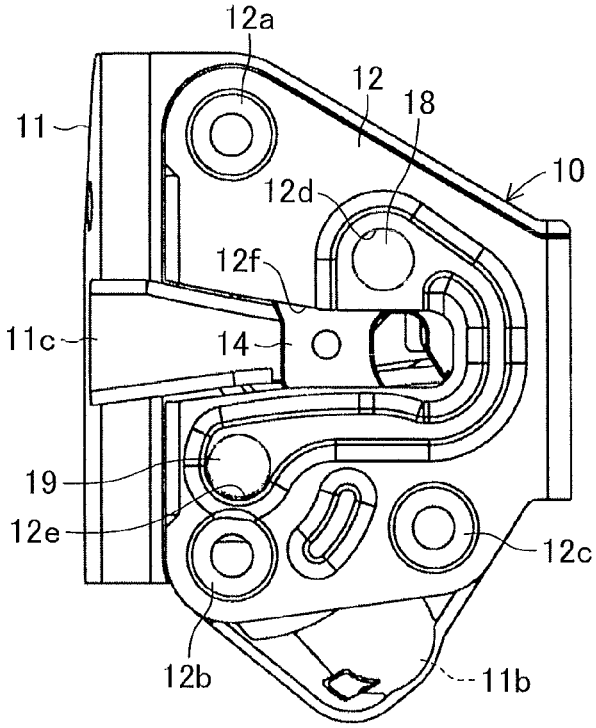
FIG. 2 is a front view of the automotive door latch device illustrated in FIG. 1 at the time when a latch is held in a door close state.

As illustrated in FIG. 2, the base plate 12 includes the bolt fixing hole parts (internal thread parts) 12*a*, 12*b*, and 12*c* described above, and further includes fitting holes 12*d* and 12*e* for the support shafts 18 and 19, and a striker insertion slit 12*f*. The base plate 12 is coupled to the sub-base plate 13 via the support shafts 18 and 19. As illustrated in FIG. 3, the sub-base plate 13 includes fitting holes 13*a* and 13*b* for the support shafts 18 and 19, and is arranged so that the body 11 and the lift lever 17 are sandwiched between the base plate 12 and the sub-base plate 13.

The latch 14 is rotatably supported on the base plate 12 and the sub-base plate 13 via the support shaft 18. The latch 14 includes a fitting hole 14*a*, a striker retaining groove 14*b*, a half latch claw 14*c*, and a full latch claw 14*d*, and further includes a spring lock hole 14*e* and an engagement projecting part 14*f*. The latch 14 is pushed to rotate by the striker 30 when the door 20 is closed, and is biased by the latch return spring S1 toward the return position illustrated in FIGS. 13 and 14 (position at which the engagement projecting part 14*f* abuts against the projection 11*m* of the body 11). The latch return spring S1 is coaxially assembled to the support shaft 18, and is housed in the housing part 11*a*1 of the body 11 together with the latch 14. One end of the latch return spring S1 is locked at the body 11 and another end thereof is locked at the spring lock hole 14*e* of the latch 14.

Figure 12:
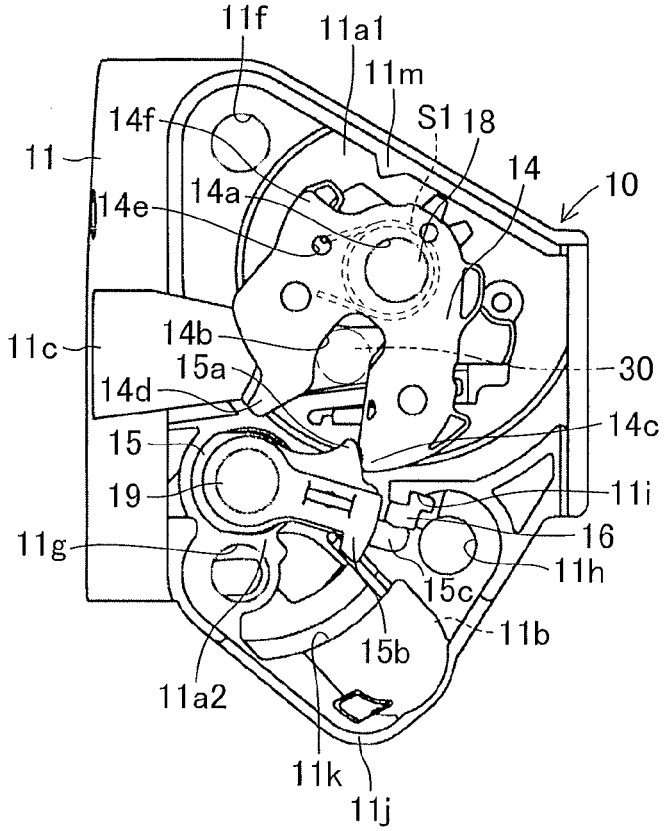
FIG. 12 is a front view of the automotive door latch device illustrated in FIG. 11 in a state in which the base plate is removed therefrom.

The fitting hole 14*a* is provided so as to rotatably assemble the latch 14 to the support shaft 18. As illustrated in FIGS. 5, 12, and 14, the striker retaining groove 14*b* is a groove where the striker 30 relatively enters and exits, and slidably engages when the door 20 is opened and closed, and as illustrated in FIGS. 5 and 12, the striker retaining groove 14*b* can retain the striker 30 together with the striker insertion slit 12*f* of the base plate 12.

Figure 11:
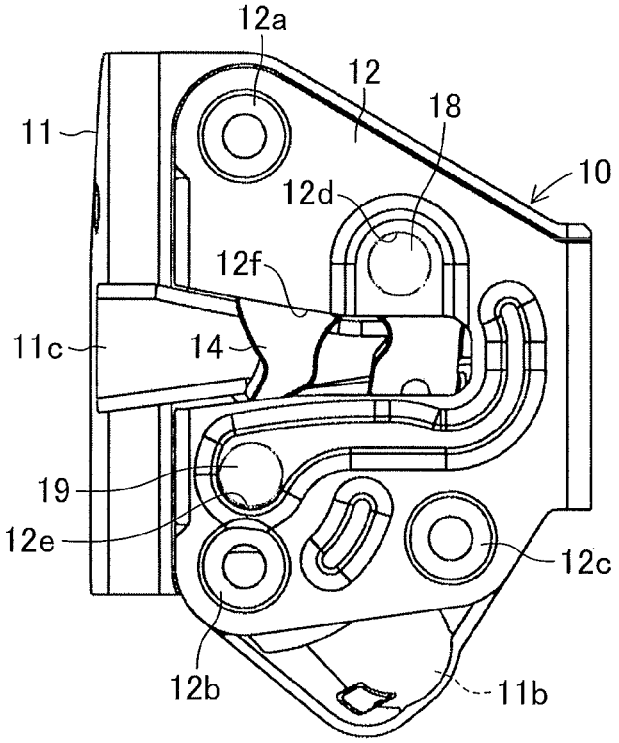
FIG. 11 is a front view of the automotive door latch device illustrated in FIG. 2 at the time when the latch is held in an improperly closed door state.
Figure 13:
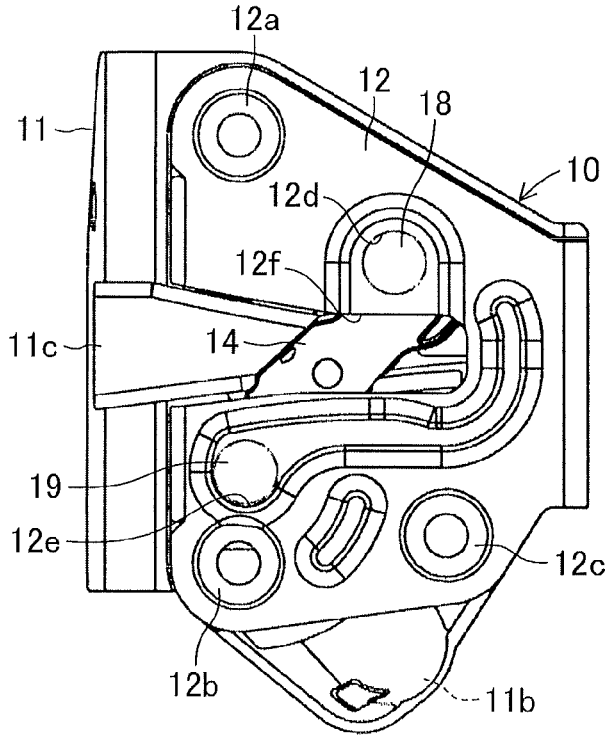
FIG. 13 is a front view of the automotive door latch device illustrated in FIG. 2 at the time when the latch is held in a door open state.

The half latch claw 14*c* slidably engages with an engagement part 15*a* of the pawl 15 under a state between a door open state illustrated in FIGS. 13 and 14 and an improperly closed door state illustrated in FIGS. 11 and 12, and under the improperly closed door state illustrated in FIGS. 11 and 12, rotation of the half latch claw 14*c* in a clockwise direction of FIG. 12 (rotation toward the return position of the latch 14) is restricted by the engagement part 15*a* of the pawl 15 situated at its return position.

The full latch claw 14*d* slidably engages with the engagement part 15*a* of the pawl 15 under a state between a nearly closed door state and a door close state illustrated in FIGS. 1 to 5, and under the door close state illustrated in FIGS. 1 to 5, rotation of the full latch claw 14*d* in the clockwise direction of FIG. 5 (rotation toward the return position of the latch 14) is restricted by the engagement part 15*a* of the pawl 15 situated at its return position.

The pawl 15 is rotatably supported on the base plate 12 and the sub-base plate 13 via the support shaft 19 together with the lift lever 17. The pawl 15 includes the engagement part 15*a* described above, and further includes a spring lock part 15*b* and an engagement projecting part 15*c*. Further, the pawl 15 is biased by the pawl return spring S2 toward the return position illustrated in FIGS. 5, 12, and 14 (position at which the engagement projecting part 15*c* abuts against the stopper 16 assembled to the body 11). Under the state illustrated in FIGS. 5 and 12, the pawl 15 engages with the latch 14 at the engagement part 15*a* to inhibit the rotation of the latch 14 toward its return position (in the door opening direction). As illustrated in FIG. 5, the engagement projecting part 15*c* is abuttable against a lower surface of the stopper 16 in a state of being inclined down toward a tip end thereof.

Note that, the pawl 15 and the support shaft 19 are integrally formed, and the lift lever 17 is assembled to the support shaft 19 so as to be rotatable integrally therewith. Therefore, when the lift lever 17 is rotated in a counterclockwise direction of FIG. 3 via the door lock device (not shown) along with a door opening operation of an outside door handle (not shown) and an inside door handle (not shown) provided to the door 20, the pawl 15 and the support shaft 19 are rotated from the return position illustrated in FIGS. 5, 12, and 14 in the clockwise direction illustrated in FIGS. 5, 12, and 14 against a biasing force of the pawl return spring S2.

The pawl return spring S2 is assembled to the spring mounting part 11*b* formed on another side of the body 11 at a position spaced obliquely downward by a predetermined amount from the rotational support part (support shaft 19) of the pawl 15. The pawl return spring S2 includes the coil part S2*a* provided at a middle portion thereof, the body-side end part S2*b* provided at one end portion thereof, and the pawl-side end part S2*c* provided at another end portion thereof. The pawl-side end part S2*c* enters the housing part 11*a*2 of the body 11 through the through hole 11*k* provided in the body 11, and engages with the spring lock part 15*b* of the pawl 15. Thus, the pawl return spring S2 is supported on the body 11 under a state in which the coil part S2*a* is arranged outside the housing parts 11*a*1 and 11*a*2 (on another side of the body 11) partially covered with the base plate 12.

In the above-mentioned door latch device 10 of this embodiment, the cutout 11*j* of the body 11 that forms the opening part A together with the base plate 12 is provided at one lower side portion of the body 11, and the housing parts 11*a*1 and 11*a*2 of the body 11 that house the latch 14 and the pawl 15, respectively, are opened downward at the position below the pawl 15. Further, the pawl return spring S2 is assembled to the spring mounting part 11*b* formed on another side of the body 11 at the position spaced downward from the rotational support part of the pawl 15. The pawl-side end part S2*c* of the pawl return spring S2 enters the housing part 11*a*2 of the body 11 through the through hole 11*k* provided in the body 11, and engages with the spring lock part 15*b* of the pawl 15.

Therefore, the size of the opening (see the opening part A of FIG. 4) formed below the housing parts 11*a*1 and 11*a*2 of the body 11 is not reduced due to the pawl return spring S2 and the spring mounting part 11*b* of the body 11. Accordingly, an opening having a necessary and sufficient size can be formed in the body 11. Thus, dust or the like entering the housing parts 11*a*1 and 11*a*2 of the body 11 can be discharged out of the body 11 with higher efficiency, and thus troubles that may occur along with deposition of the dust or the like can be suppressed effectively.

Further, the pawl return spring S2 is assembled to the spring mounting part 11*b* formed on another side of the body 11 at the position spaced obliquely downward from the rotational support part (support shaft 19) of the pawl 15. Accordingly, the pawl return spring S2 can be arranged with a higher degree of freedom than in the case where the pawl return spring is coaxially assembled to the rotational support part (support shaft 19) of the pawl 15.

Further, in the door latch device 10 of this embodiment, the pawl return spring S2 includes the coil part S2*a* provided at the middle portion thereof, the body-side end part S2*b* provided at one end portion thereof, and the pawl-side end part S2*c* provided at another end portion thereof. Further, the spring mounting part 11*b* formed on the body 11 includes the shaft part 11*b*1 and the arc-like wall part 11*b*2 (retaining part) for retaining the coil part S2*a*, and the lock part 11*b*3 engaging with the body-side end part S2*b*.

Accordingly, under a sub-assembly state obtained by combining the components other than the pawl return spring S2 (body 11, base plate 12, sub-base plate 13, latch 14, pawl 15, stopper 16, lift lever 17, support shaft 18 of the latch, support shaft 19 of the pawl, latch return spring S1, and the like), the pawl-side end part S2*c* of the pawl return spring S2 is passed through the through hole 11*k* of the body 11, and is inserted into the housing part 11*a*2 of the body 11 so that the pawl-side end part S2*c* is engaged with the spring lock part 15*b* of the pawl 15. Subsequently, the coil part S2*a* of the pawl return spring S2 is assembled to the retaining part (11*b*1 and 11*b*2) of the spring mounting part 11*b* formed on the body 11, and finally, the body-side end part S2*b* of the pawl return spring S2 is assembled to the lock part 11*b*3 provided in the spring mounting part 11*b*. Consequently, the pawl return spring S2 can be assembled. Therefore, the biasing force of the pawl return spring S2 does not hinder the assembly of the components when the sub-assembly is obtained by combining the components other than the pawl return spring S2, and thus the components can be assembled with satisfactory efficiency when the sub-assembly is obtained.

Further, in the door latch device 10 of this embodiment, as illustrated in FIG. 5, the stopper 16 that defines the return position of the pawl 15 is assembled to the stopper mounting part 11*i* of the body 11 (at the portion projecting in a canopy shape between the housing parts 11*a*1 and 11*a*2). Further, the stopper 16 is arranged above the engagement projecting part 15*c* of the pawl 15 that is biased by the pawl return spring S2 in the counterclockwise direction of FIG. 5, and the engagement projecting part 15*c* of the pawl 15 is abuttable against the lower surface of the stopper 16 in a state of being inclined down toward the tip end thereof. Therefore, dust or the like is not easily deposited between the engagement projecting part 15*c* of the pawl 15 and the stopper 16, and accordingly shift of the return position of the pawl 15 due to the dust or the like can be suppressed. Thus, the function of the pawl 15 (function of inhibiting the rotation of the latch 14 in the door opening direction at a predetermined position) can be obtained stably for a long period of time.

In the embodiment described above, the present invention is carried out by providing, in the spring mounting part 11*b* of the body 11, the shaft part 11*b*1 and the arc-like wall part 11*b*2 (retaining part) for retaining the coil part S2*a* of the pawl return spring S2, but the shape of the retaining part for retaining the coil part S2*a* of the pawl return spring S2 may be modified as appropriate, and the present invention may be carried out by omitting, for example, any one of the shaft part 11*b*1 and the arc-like wall part 11*b*2.

Figure 15:
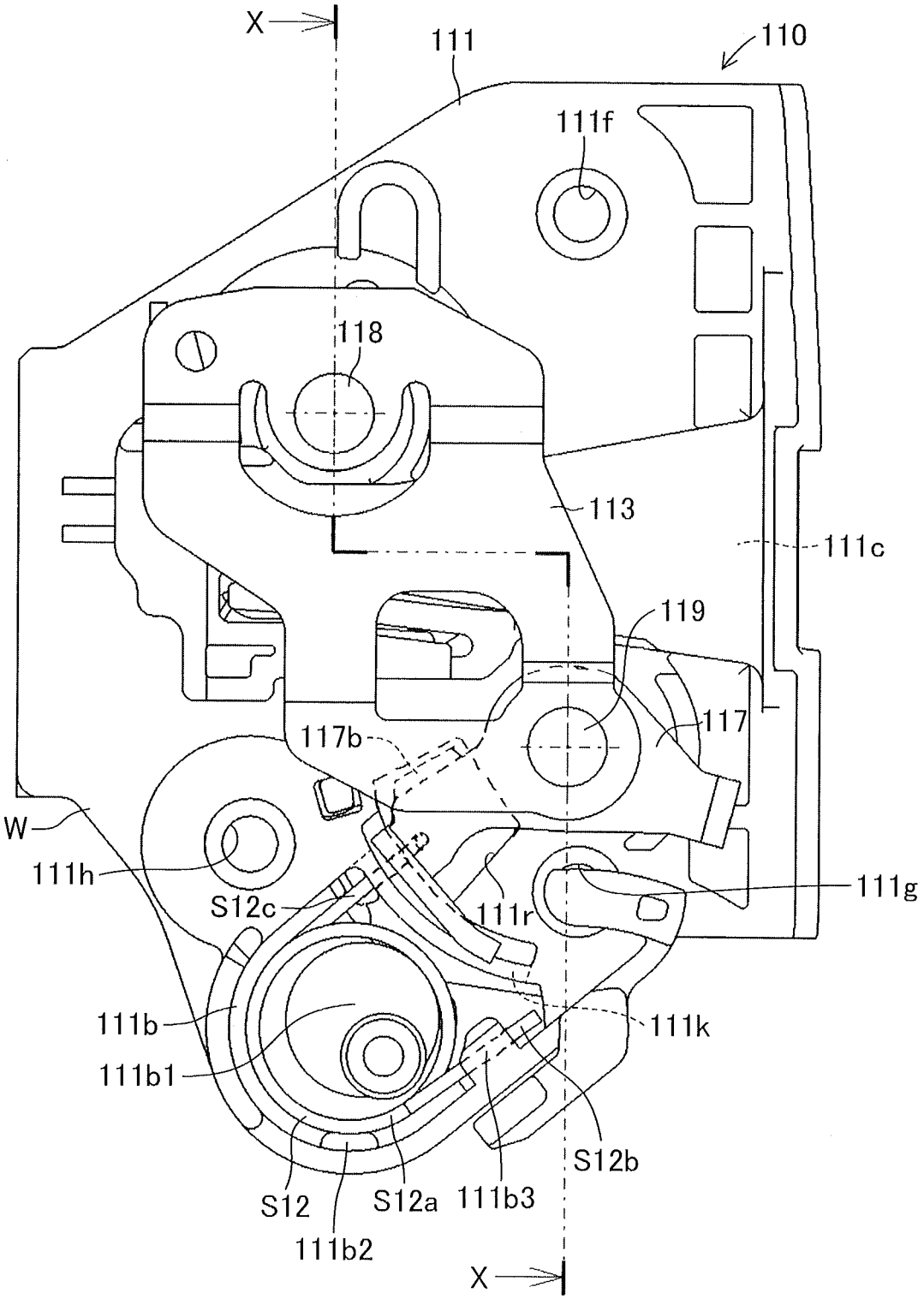
FIG. 15 is a rear view corresponding to FIG. 3, for illustrating an automotive door latch device according to another embodiment (second embodiment) of the present invention.
Figure 16:
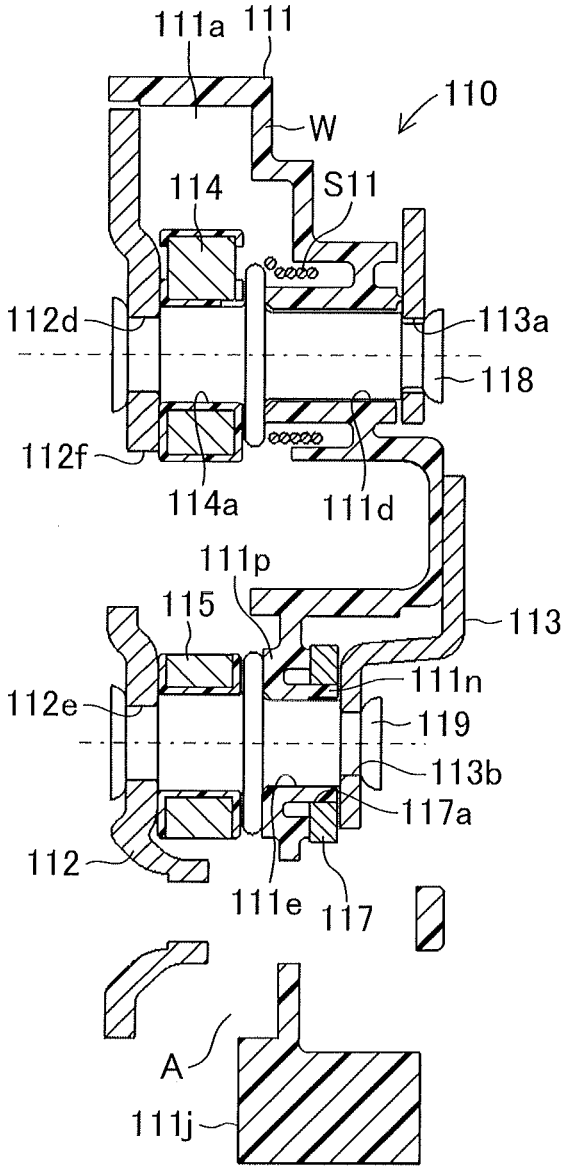
FIG. 16 is an end view cut along the line X-X of FIG. 15.

FIGS. 15 and 16 illustrate an automotive door latch device according to another embodiment (second embodiment) of the present invention. As in the above-mentioned automotive door latch device 10 illustrated in FIGS. 1 to 5, an automotive door latch device 110 of this embodiment is mounted together with a door lock device (not shown) to a door (see the imaginary lines of FIG. 1) equipped on a front right side of an automobile. The automotive door latch device 110 includes a body 111 made of a resin, a base plate 112 made of a steel plate, and a sub-base plate 113 made of a steel plate, and further includes a latch 114 made of a metal and having a surface partially coated with a resin, a latch return spring S11 made of spring steel, a pawl 115 made of a metal and having a surface partially coated with a resin, a pawl return spring S12 made of spring steel, a stopper (formed similarly to the stopper 16 of the above-mentioned embodiment) made of rubber, and a lift lever 117 made of a steel plate (metal).

The body 111 includes a housing part 111*a* for housing the latch 114 and the pawl 115, respectively, and the housing part 111*a* is formed on one side of a longitudinal wall W (side on which the base plate 112 is assembled) interposed between the base plate 112 and the sub-base plate 113. The body 111 further includes a spring mounting part 111*b* for assembling the pawl return spring S12, and the spring mounting part 111*b* is formed on another side of the longitudinal wall W (side on which the sub-base plate 113 is assembled). Further, the body 111 includes a striker insertion groove 111*c*, two support shaft insertion holes 111*d* and 111*e*, three bolt insertion holes 111*f*, 111*g*, and 111*h*, and a stopper mounting part (formed similarly to the stopper mounting part 11*i* of the above-mentioned embodiment), and further includes a cutout 111*j* (see FIG. 16), a through hole 111*k*, and a projection (formed similarly to the projection 11*m* of the above-mentioned embodiment).

As illustrated in FIG. 16, the housing part 111*a* houses the latch 114 and the pawl 115 so that the latch 114 and the pawl 115 are each pivotable by a predetermined amount, and is partially covered with the base plate 112 on one side of the housing part 111*a* (left side of FIG. 16). The spring mounting part 111*b* is formed on another side of the body 111 at a position spaced obliquely downward from a rotational support part (support shaft 119) of the pawl 115, and as illustrated in FIG. 15, the spring mounting part 111*b* includes a shaft part 111*b*1 and a projection 111*b*2 (retaining part) for retaining a coil part S12*a* of the pawl return spring S12, and a lock part 111*b*3 engaging with a body-side end part S12*b* of the pawl return spring S12. Note that, the lock part 111*b*3 is formed separately from the projection 111*b*2 in a projecting manner.

The striker insertion groove 111*c* is a groove where a known striker (not shown) assembled on a vehicle body side relatively enters and exits when the door is opened and closed, and is formed horizontally at a center of the body 111. The upper support shaft insertion hole 111*d* is a through hole, through which a support shaft 118 (first support shaft) made of a metal for rotatably supporting the latch 114 is inserted. On the other hand, the lower support shaft insertion hole 111*e* is a through hole, through which the support shaft 119 (second support shaft) which is made of a metal and rotatably supports the pawl 115 is inserted.

The three bolt insertion holes 111*f*, 111*g*, and 111*h* are insertion holes, through which, when the door latch device 110 is assembled to the door (20) with three bolts (see the bolts 21, 22, and 23 of FIG. 1), tip end portions of the bolts are inserted while being screwed into bolt fixing hole parts (internal thread parts) provided in the base plate 112. The stopper mounting part formed similarly to the stopper mounting part 11*i* of the above-mentioned embodiment, and the stopper (16) is fitted and fixed to the stopper mounting part as in the above-mentioned embodiment.

As illustrated in FIG. 16, the cutout 111*j* is provided at one lower side portion of the body 111, and forms an opening part A together with the base plate 112. The opening part A opens the housing part 111*a* downward at a position below the pawl 115, and is formed into a rectangular shape as seen from the lower side. The through hole 111*k* is formed into an arc shape in the longitudinal wall W at a position between the housing part 111*a* and the spring mounting part 111*b* described above, and a pawl-side end part S12*c* of the pawl return spring S12 is insertable into the through hole 111*k*. Further, the through hole 111*k* has a long hole shape (longitudinal end portions of the long hole are indicated by the broken lines in FIG. 15) elongated so as to allow movement of the pawl-side end part S12*c* of the pawl return spring S12 in a movement direction, in which the pawl-side end part S12*c* moves when the pawl 115 pivots to allow the pivot of the latch 114, beyond a range in which the pawl-side end part S12*c* moves when the pawl 115 pivots.

The base plate 112 includes the bolt fixing hole parts (internal thread parts) described above, and further includes fitting holes 112*d* and 112*e* for non-rotatably supporting the support shafts 118 and 119 on one end side thereof (left end side in FIG. 16), respectively, and a striker insertion slit 112*f*. The base plate 112 is coupled to the sub-base plate 113 via the support shafts 118 and 119. The sub-base plate 113 includes fitting holes 113*a* and 113*b* for non-rotatably supporting the support shafts 118 and 119 on another end side thereof (right end side in FIG. 16), respectively, and is arranged so that the body 111 is sandwiched between the base plate 112 and the sub-base plate 113 and the lift lever 117 is retained therebetween.

The latch 114 is rotatably supported by the support shaft 118, which is non-rotatably supported by the base plate 112 and the sub-base plate 113. The latch 114 includes a fitting hole 114*a* (which is coated with a resin over its entire circumference) for rotatably assembling the latch 114 to the support shaft 118, and further includes a striker retaining groove, a half latch claw, a full latch claw, a spring lock hole, and an engagement projecting part corresponding to the striker retaining groove 14*b*, the half latch claw 14*c*, the full latch claw 14*d*, the spring lock hole 14*e*, and the engagement projecting part 14*f* of the above-mentioned embodiment. The latch 114 is pushed to rotate by the striker when the door is closed, and as in the above-mentioned embodiment, is biased by the latch return spring S11 toward the return position. The latch return spring S11 is coaxially assembled to the support shaft 118, and is housed in the housing part 111*a* of the body 111 together with the latch 114. One end of the latch return spring S11 is locked at the body 111 and another end thereof is locked at the spring lock hole of the latch 114.

The pawl 115 is rotatably supported by the support shaft 119, which is non-rotatably supported by the base plate 112 and the sub-base plate 113. The pawl 115 includes an engagement part, a spring lock part, and an engagement projecting part corresponding to the engagement part 15*a*, the spring lock part 15*b*, and the engagement projecting part 15*c* of the above-mentioned embodiment. Further, as in the above-mentioned embodiment, the pawl 15 is biased by the pawl return spring S12 toward the return position. The pawl 115 engages with the latch 114 at the engagement part (not shown) to inhibit the rotation of the latch 114 toward its return position (in the door opening direction). As in the above-mentioned embodiment (see FIG. 5), the engagement projecting part (not shown) is abuttable against a lower surface of the stopper assembled to the body 111 in a state of being inclined down toward a tip end thereof.

Further, in this embodiment illustrated in FIGS. 15 and 16, the body 111 includes a cylindrical extending part 111*n* and a cylindrical support part 111*p* illustrated in FIG. 16, and further includes a rectangular opening part 111*r* illustrated in FIG. 15. Further, the lift lever 117 includes an insertion hole 117*a* (see FIG. 16), through which the support shaft 119 illustrated in FIG. 15 is insertable, and further includes a projecting part 117*b* (see FIG. 15) bent toward the pawl 115 to pass through the opening part 111*r* of the body 111.

The extending part 111*n* of the body 111 rotatably supports the lift lever 117. The extending part 111*n* extends along the support shaft 119, and is inserted through the insertion hole 117*a* of the lift lever 117 so that the extending part 111*n* is interposed between the lift lever 117 and the support shaft 119 and surrounds the entire circumference of the support shaft 119. The support part 111*p* of the body 111 extends in a radially outer direction and in an axial direction by a predetermined amount and extends in a circumferential direction from the extending part 111*n* on the base plate side thereof. Therefore, the lift lever 117 rotatably supported on the extending part 111*n* of the body 111 is disposed between the support part 111*p* of the body 111 and the sub-base plate 113. Further, the sub-base plate 113 is positioned in the axial direction by the extending part 111*n* of the body 111.

The projecting part 117*b* of the lift lever 117 passes through the opening part 111*r* of the body 111, and is fittable to a depressed part provided in an end surface of the pawl 115 on the sub-base plate 113 side (formed similarly to an I-shaped depressed part 15*d* provided in the pawl 15 of FIG. 5). Further, when the projecting part 117*b* of the lift lever 117 is fitted to the above-mentioned depressed part (15*d*) of the pawl 115, the lift lever 117 and the pawl 115 can rotate integrally with each other, and the rotation (rotation corresponding to the rotation of the pawl 115 for separating from the stopper) is allowed through the opening part 111*r* of the body 111. Note that, the above-mentioned depressed part (15*d*) of the pawl 115 may be formed as a through hole.

In the embodiment configured as described above, which is illustrated in FIGS. 15 and 16, the following actions and effects can be obtained as well as the actions and effects similar to those of the above-mentioned embodiment illustrated in FIGS. 1 to 14. In this embodiment illustrated in FIGS. 15 and 16, the through hole 111*k* provided in the body 111 has the long hole shape as described above. Accordingly, the pawl-side end part S12*c* of the pawl return spring S12 is easily assembled to the body 111, and thus the pawl return spring S12 can be assembled with enhanced efficiency.

Further, in this embodiment illustrated in FIGS. 15 and 16, the support shaft 119 is made of a metal, and the lift lever 117 assembled so as to be rotatable integrally with the pawl 115 is also made of a metal. The body 111 is made of a resin and includes the above-mentioned extending part 111*n*. Accordingly, a bush (resin bearing) function can be imparted to the extending part 111*n* of the body 111 that is made of a resin, and thus metallic contact between the lift lever 117 and the support shaft 119 can be eliminated without adding components. Therefore, noise due to the metallic contact occurring when the lift lever 117 is actuated can be prevented. In particular, in this embodiment, the extending part 111*n* is formed into a cylindrical shape and surrounds the entire circumference of the support shaft 119, and thus the above-mentioned noise due to the metallic contact can be prevented more suitably.

Further, in this embodiment illustrated in FIGS. 15 and 16, the base plate 112 non-rotatably supports the support shaft 119 on one end side thereof, and the sub-base plate 113, which is assembled on another side of the body 111 and is positioned by the extending part 111*n*, non-rotatably supports the support shaft 119 at another end portion thereof. Further, the pawl 115 and the lift lever 117 are rotatably supported on the support shaft 119. Further, the body 111 includes the support part 111*p* extending in the circumferential direction from the extending part 111*n* on the base plate side thereof, and the lift lever 117 is disposed between the support part 111*p* of the body 111 and the sub-base plate 113. Therefore, the lift lever 117 can be prevented from being sandwiched between the support part 111*p* of the body 111 and the sub-base plate 113, and thus smooth rotation of the lift lever 117 can be guaranteed.

Further, in this embodiment, a part of the pawl 115 (depressed part) and a part of the lift lever 117 (projecting part 117*b*) are fitted to each other in the axial direction. Accordingly, the pawl 115 and the lift lever 117 can be coupled to each other so as to be rotatable integrally with each other. Therefore, manufacturability can be enhanced as compared to a case where, for example, the pawl (115) and the support shaft (119) are integrated, the lift lever (117) is fixed to the support shaft (119) by caulking or the like, and the support shaft (119) is rotatably coupled to the base plate 112 and the sub-base plate 113.

Further, in this embodiment illustrated in FIGS. 15 and 16, the lift lever 117 includes the projecting part 117*b* bent toward the pawl 115 to pass through the body 111, and the pawl 115 includes the depressed part (15*d*) fittable to the projecting part 117*b*. Further, the body 111 includes the opening part 111*r* that allows the passage and rotation of the projecting part 117*b*. The projecting part 117*b* passes through the opening part 111*r* and is fitted to the depressed part (15*d*) so that the lift lever 117 and the pawl 115 are rotatable integrally with each other. Therefore, the pawl 115 and the lift lever 117 can be coupled to each other so as to be rotatable integrally with each other without providing a separate component, such as a coupling pin, to the lift lever 117, and thus the pawl 115 and the lift lever 117 can be formed simply at low cost.

In the embodiment illustrated in FIGS. 15 and 16, the present invention is carried out by integrally providing the projecting part 117*b* to the lift lever 117, but the present invention may be carried out by using a separate member such as a pin (member fastened to the lift lever 117 and fittable to the depressed part (15*d*) of the pawl 115) instead of the projecting part 117*b*. Further, in the embodiment illustrated in FIGS. 15 and 16, the present invention is carried out by forming the extending part 111*n* into a cylindrical shape (arranging the extending part 111*n* on the entire circumference), but the present invention may be carried out by arranging the extending part (111*n*) partially in the circumferential direction (for example, providing a plurality of extending parts in the circumferential direction at regular intervals).

The invention claimed is:

1. An automotive door latch device, comprising:

a base plate adapted to be assembled to a door;

a body comprising a housing part formed on one side thereof, the housing part being covered with the base plate on one side thereof;

a latch housed in the housing part of the body and rotatably supported on the base plate via a first support shaft, the latch being adapted to be pushed to rotate by a striker on a vehicle body side;

a latch return spring housed in the housing part of the body, for biasing the latch toward a return position thereof;

a pawl housed in the housing part of the body at a position below the latch and rotatably supported on the base plate via a second support shaft to rotate about a rotation axis, the pawl being engageable with the latch to inhibit the latch to pivot in a door opening direction;

a pawl return spring for biasing the pawl toward a return position of the pawl;

wherein the housing part of the body is opened downward at a position below the pawl;

wherein the pawl return spring includes a coil part mounted on a spring mounting part formed on another side of the body at a position spaced downward from a rotational support part of the pawl, the coil part possessing a central axis, the pawl return spring comprises a pawl-side end part that enters the housing part of the body through a through hole provided in the body, and engages with the pawl; and the rotation axis of the pawl being different from the central axis of the coil part.

2. An automotive door latch device according to claim 1, wherein the spring mounting part formed on the body comprises:

a retaining part for retaining the coil part; and a lock part engaging with the body-side end part.

3. An automotive door latch device according to claim 1, wherein the through hole has a long hole shape elongated so as to allow movement of the pawl-side end part of the pawl return spring in a movement direction, in which the pawl-side end part moves when the pawl pivots to allow the pivot of the latch, beyond a range in which the pawl-side end part moves when the pawl pivots.

4. An automotive door latch device according to claim 1, wherein the second support shaft that rotatably supports the pawl is made of a metal, wherein the automotive door latch device further comprises a lift lever made of a metal, the lift lever comprising an insertion hole, through which the second support shaft is insertable, the lift lever being assembled to the second support shaft so as to be rotatable integrally with the pawl, and wherein the body is made of a resin, and further comprises an extending part, which extends along the second support shaft and is inserted through the insertion hole of the lift lever so that the extending part is interposed between the lift lever and the second support shaft and rotatably supports the lift lever.

5. An automotive door latch device according to claim 4, wherein the extending part is formed into a cylindrical shape, and surrounds an entire circumference of the second support shaft.

6. An automotive door latch device according to claim 4, wherein the base plate non-rotatably supports the second support shaft on one end side thereof, wherein the automotive door latch device further comprises a sub-base plate, which is assembled on the another side of the body and is positioned by the extending part, the sub-base plate non-rotatably supporting the second support shaft at another end portion thereof, wherein the pawl and the lift lever are rotatably supported on the second support shaft, wherein the body further comprises a support part extending in a circumferential direction from the extending part on the base plate side thereof, and wherein the lift lever is disposed between the support part of the body and the sub-base plate.

7. An automotive door latch device according to claim 4, wherein the lift lever further comprises a projecting part bent toward the pawl to pass through the body, wherein the pawl comprises a depressed part fittable to the projecting part, wherein the body further comprises an opening part that allows passage and rotation of the projecting part, and wherein the projecting part passes through the opening part and is fitted to the depressed part so that the lift lever and the pawl are rotatable integrally with each other.

8. An automotive door latch device according to claim 1, wherein the pawl further comprises an engagement projecting part, and wherein the automotive door latch device further comprises a stopper mounted to the body so as to be arranged above the engagement projecting part, the stopper abutting against the engagement projecting part to define the return position of the pawl.

9. An automotive door latch device, comprising:

a base plate adapted to be assembled to a door;

a body comprising a wall with a housing part located on one side of the wall, the base plate covering the housing part;

the wall including a through hole passing through the wall from the one side of the wall to an opposite side of the wall that is opposite the one side;

a latch housed in the housing part on the one side of the wall and rotatably supported on a first support shaft, the latch being adapted to be pushed to rotate by a striker on a vehicle body side;

a latch return spring housed in the housing part on the one side of the wall, the latch return spring including one end portion engaging the latch and biasing the latch toward a return position of the latch;

a pawl housed in the housing part on the one side of the wall and rotatably supported on a second support shaft spaced from the first support shaft to rotate about a rotation axis, the pawl being engageable with the latch to inhibit the latch from pivoting in a door opening direction;

a pawl return spring that includes a coil part possessing a central axis, a first end part and a second end part;

the coil part of the pawl return spring being mounted on a spring mounting part positioned on the opposite side of the wall so that the coil part is on the opposite side of the wall;

the first end part of the pawl return spring passing through the through hole so that the first end part is positioned on the one side of the wall and engages the pawl to bias the pawl toward a return position; and the rotation axis of the pawl being different from the central axis of the coil part.

10. An automotive door latch device according to claim 9, wherein the spring mounting part on the body comprises a projecting shaft positioned inside the coil part and an arc-shaped wall part spaced from the projecting shaft so that a space exists between an outer surface of the projecting shaft and an inner surface of the arc-shaped wall part, the coil part of the pawl return spring being positioned in the space.

11. An automotive door latch device according to claim 10, wherein the spring mounting part further comprises a lock part extending from the arc-shaped wall part and engaging the second end part of the pawl return spring.

12. An automotive door latch device according to claim 9, wherein the through hole passing through the wall possesses an elongated shape to allow movement of the first end part of the pawl return spring in a movement direction, in which the first end part moves when the pawl pivots to allow pivoting of the latch, beyond a range in which the first end part moves when the pawl pivots.

13. An automotive door latch device according to claim 9, wherein the second support shaft that rotatably supports the pawl is made of metal, and further comprising a lift lever made of metal, the lift lever comprising an insertion hole through which the second support shaft extends, the lift lever being assembled on the second support shaft and being rotatable together with the pawl.

14. An automotive door latch device according to claim 13, further comprising an extending part, which extends along and surrounds the second support shaft and passes through the insertion hole of the lift lever so that the extending part is interposed between the lift lever and the second support shaft and rotatably supports the lift lever.

15. An automotive door latch device according to claim 14, wherein the extending part is cylindrically shaped, and surrounds an entire circumference of the second support shaft along one axial portion of the second support shaft.

16. An automotive door latch device according to claim 9, further comprising a lift lever provided with an insertion hole through which the second support shaft extends so that the lift lever is rotatably supported on the second support shaft.

17. An automotive door latch device according to claim 9, further comprising a lift lever provided with an insertion hole through which the second support shaft extends, the lift lever further comprising a projecting part bent toward the pawl and passing through an opening in the body, the pawl comprising a depressed part fitted to the projecting part, the body further comprising an opening through which the projecting part passes and is fitted to the depressed part so that the lift lever and the pawl rotate integrally with each other.

18. An automotive door latch device according to claim 9, the pawl comprising an engagement projecting part against which abuts a stopper mounted to the body to define the return position of the pawl.

* * * * *